United States Patent [19]

Wentzek

[11] 3,954,125

[45] May 4, 1976

[54] WIRE LINK CHAIN AND WIRE FABRIC AND METHOD AND APPARATUS THEREFOR

[75] Inventor: Horst F. Wentzek, Kenosha, Wis.

[73] Assignee: Frank L. Wells Company, Kenosha, Wis.

[22] Filed: Apr. 9, 1975

[21] Appl. No.: 566,230

[52] U.S. Cl. ..... 140/3 A; 140/104; 245/9

[51] Int. Cl.[2] ..... B21F 27/04

[58] Field of Search..... 140/3 R, 3 A, 101, 104, 140/114, 115; 59/21; 245/9; 72/702

[56] References Cited

UNITED STATES PATENTS

| | | | |
|---|---|---|---|
| 758,920 | 5/1904 | Hunt | 245/9 |
| 1,126,746 | 2/1915 | Gail | 140/3 |
| 1,186,843 | 6/1916 | Ryan | 245/9 |
| 2,439,893 | 4/1948 | Iden | 72/131 |
| 3,166,947 | 1/1965 | Hendershot | 74/216.5 |

*Primary Examiner*—Lowell A. Larson
*Attorney, Agent, or Firm*—Michael, Best & Friedrich

[57] ABSTRACT

Disclosed herein is a mechanism adapted for twisting an eye formed at one end of a U-shaped link, said mechanism comprising a frame, an input shaft supported by the frame for rotation and adapted to be rotated by a power source, a clamp on the frame for gripping the link against movement and with the eye extending from the clamp, and a rotatable head on the frame and connected to the input shaft and engagable with the extending eye for twisting the eye in one direction through a first angular distance in response to one portion of the rotational cycle of the input shaft and for additionally twisting the eye in the one direction through an additional angular distance in response to another portion of the rotational cycle of the input shaft.

Also disclosed herein is a wire chain and a wire fabric and methods of making the same incorporating the operation of the above disclosed eye twisting mechanism.

25 Claims, 7 Drawing Figures

51
11
54
53
131
129
143
125
127
85
83
75
91
79
73
78
76
71
149
97
141
101
99
93
145
146
61
77
63
95
147
115
111
113
123
121
87
74

WIRE LINK CHAIN AND WIRE FABRIC AND METHOD AND APPARATUS THEREFOR

BACKGROUND OF THE INVENTION

The invention relates generally to wire fabrics for mattresses, cushions and the like and to link chains for use in such wire fabrics, and to methods of manufacturing such link chains and wire fabrics.

The invention also relates to apparatus for fabricating such link chains and such wire fabrics.

In the past, as shown in FIG. 1, link chains 2 and wire fabrics made therefrom have been constructed by machines which twisted the bite portions or eyes 4 of successive wire links 6 in opposite rotative directions so that the eyes 4 of the links 6 in the chains 2 were alternately twisted in opposite directions.

Attention is directed to the Hendershot U.S. Pat. No. 3,166,947, issued Jan. 26, 1975.

SUMMARY OF THE INVENTION

The invention provides link chains, wire fabrics of such link chains, methods of fabricating such link chains and wire fabrics, and apparatus for twisting the eyes of the links of such chains, such that all of the eyes are twisted in the same rotative direction. Preferably, all the eyes are also located in generally co-planar relation to the main body or leg portions of the link.

More specifically, the invention provides apparatus or mechanism adapted for twisting an eye formed at one end of a U-shaped link, which apparatus comprises a frame, an input shaft supported by the frame for rotation and adapted to be rotated by a power source, means on the frame for gripping the link against movement and with the eye extending from the gripping means, and means on the frame and connected to the input shaft for twisting the eye in one direction through a first angular distance in response to one portion of the rotational cycle of the input shaft and for additionally twisting the eye in the same rotative direction through an additional angular distance in response to another portion of the rotational cycle of the input shaft, which twisting means includes a rotatable head engagable with the extending eye and a linkage extending between the input shaft and the head and including two alternately moving portions.

In one embodiment of the invention, the linkage includes an output shaft rotatably supported by the frame, means connected between the input shaft and the output shaft for intermittently rotating the output shaft in response to rotation of the input shaft, means connected between the output shaft and the head for rotating the head to twist the eye in one direction through a first angular distance in response to rotation of the output shaft, and additional means connected to the input shaft and to the means connected between the output shaft and the head for additionally rotating the head to twist the eye in said one direction through an additional angular distance in response to rotation of the input shaft during non-rotation of the output shaft.

In one embodiment of the invention, the linkage further comprises first, second, third and fourth spaced sprockets rotatably mounted by the frame about axes fixed with respect to the frame and with the first sprocket being drivingly connected to the head and with the second sprocket being rotatably driven by the output shaft, an endless chain having an inside surface trained around the first, second, third, and fourth sprockets, and having an outside surface, a member mounted on the frame for movement relative thereto, fifth and sixth sprockets mounted on the member in spaced relation for rotation about axes fixed relative to the member and engaging the outside surface of the chain to arrange the chain with two oppositely extending outwardly concave portions, and means connected between the member and the input shaft for displacing the member in response to rotation of the input shaft and when the second sprocket is held against rotation by the output shaft so as to effect movement of the chain relative to the first sprocket such that the first sprocket is additionally rotated in said one direction.

In a particularly preferred embodiment, the means for displacing the member includes means permitting adjustment of the displacement distance of the member so as to adjustably vary the amount of additional twisting.

The invention further provides a wire link chain comprising a plurality of generally identically constructed links connected to one another in series, all of which links include two parallel, generally co-planar leg portions integrally interconnected at one end thereof by a bite portion which is formed to provide an eye and which is twisted relative to the leg portions in one rotative direction through an angle of at least about 180° into co-planar relation to the leg portions, which leg portions each have, at the other end thereof, respective loops extending through the eye of the adjacent link in the series.

In addition, the invention provides a wire fabric for a mattress or the like comprising a plurality of link chains, each of said link chains comprising a plurality of generally identically constructed links connected to one another in series, all of which links include two parallel, generally co-planar leg portions integrally interconnected, at one end thereof, by a bite portion which is formed to provide an eye, and which is twisted relative to the leg portions in one rotative direction through an angle of at least about 180° into co-planar relation to the leg portions, which leg portions each have, at the other end thereof, respective loops extending through the eye of the adjacent link in the associated one of the chains, and a plurality of cross members connecting the link chains, each of which cross members includes, at each end, respective loops extending through respective eyes of the links in the adjacent chains.

Still further, the invention provides a method of fabricating a chain of links for a wire fabric comprising the steps of forming a plurality of wire lengths into U-shaped links each having a pair of co-planar parallel leg portions integrally connected by a bite portion forming an eye, twisting the bite portions of all of the links in the same rotative direction relative to the leg portions through a predermined angular distance of at least about 180° to locate the eyes in generally co-planar relation to the leg portions, and assembling the links to one another with the bit portions all being twisted in the same direction and all being in generally co-planar relation to one another.

Still further, the invention provides a method of fabricating a wire fabric for a sleeping surface, such as a mattress or the like, comprising the steps of forming a plurality of wire lengths into U-shaped links each having a pair of co-planar parallel leg portions integrally connected by a bite portion forming an eye, twisting the bite portions of all of the links in the same rotative direction relative to the leg portions through a predetermined angular distance of at least about 180° to locate the eyes in generally co-planar relation to the leg portions, assembling the links to one another to provide a plurality of link chains with all of the bite portions being twisted in the same direction and being in generally co-planar relation to one another, and assembling the link chains to one another in generally parallel relation.

One of the principal features of the invention is the provision of apparatus for twisting all of the eyes of a plurality of U-shaped wire links in the same rotative direction.

Another of the principal features of the invention is the provision of apparatus as referred to in the preceding paragraph, and including mechanism for additionally twisting the eyes through an additional adjustable amount in the same rotative direction so that upon self rebending or retwisting in the reverse direction, the eyes will be located in generally co-planar relation to the legs of the U-shaped links.

Another of the principal features of the invention is the provision of a chain of interconnected U-shaped wire links, all of which links includes eyes which are all twisted in the same rotative direction and are generally co-planar to the leg portions or main body of such links.

Another of the principal features of the invention is the provision of a wire fabric including a plurality of link chains as referred to in the preceding paragraph.

Still another of the principal features of the invention is the provision of a method for fabricating the link chains and wire fabrics referred to in the top preceding paragraphs.

Other features and advantages of the invention will become known by reference to the accompanying drawings and the following general description and claims.

IN THE DRAWINGS

Figure 1:
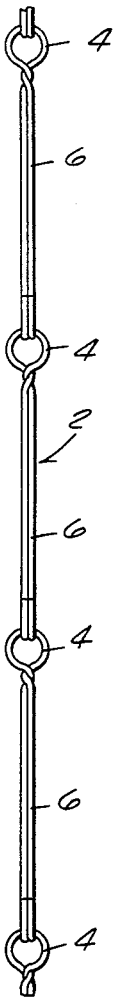
Fig. 1 PRIOR ART
FIG. 1 is a front view of a prior art chain of wire links.

Before explaining the embodiments of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 2:
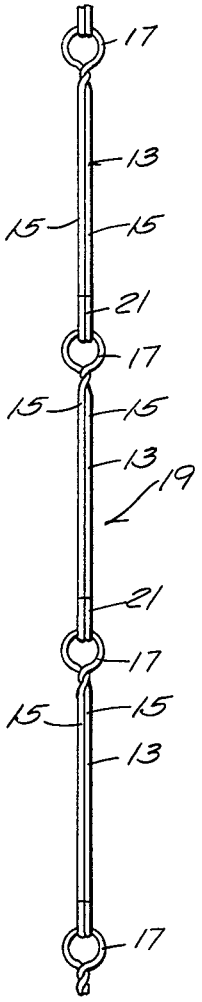
FIG. 2 is a front view of a chain of wire links, which chain embodies various of the features of the invention.
Figure 3:
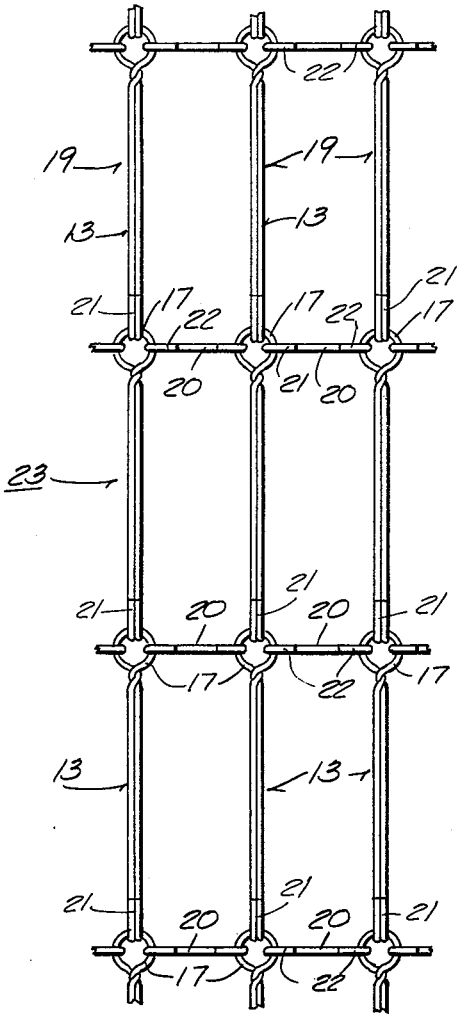
FIG. 3 is a front view of a wire fabric which embodies a plurality of the link chains shown in FIG. 2 and which incorporates various of the features of the invention.
Figure 4:
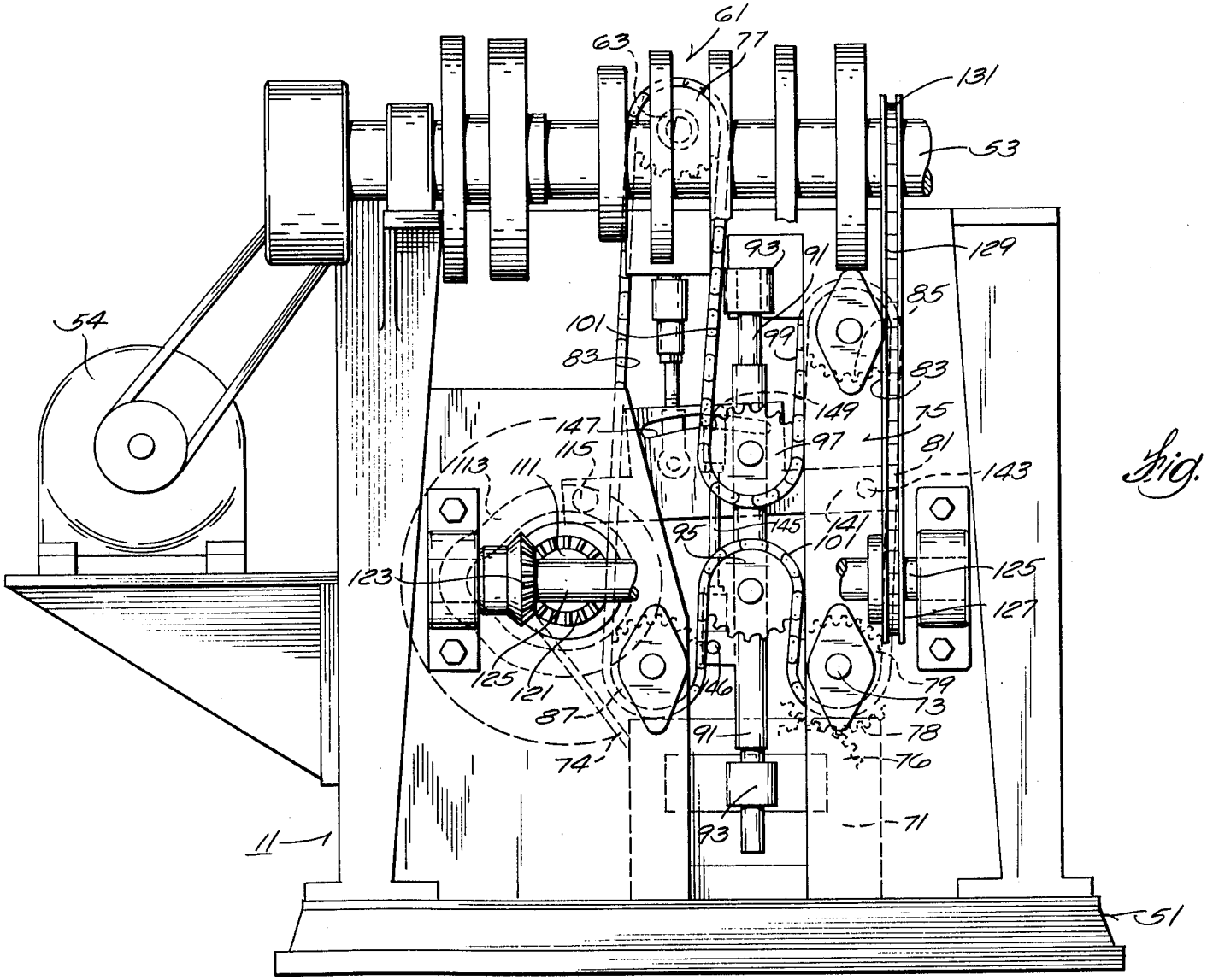
FIG. 4 is a fragmentary partially schematic elevational view, with parts broken away, of an apparatus which incorporates various of the features of the invention and which is adapted to fabricate the link chain and wire fabric shown in FIGS. 2 and 3.
Figure 5:
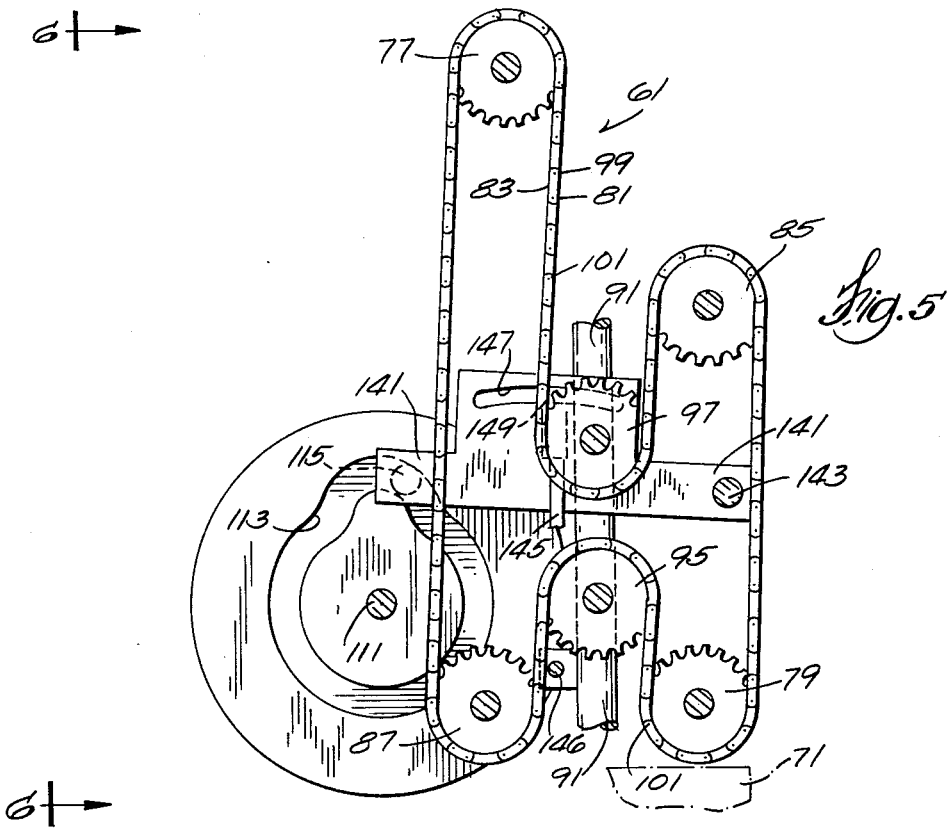
FIG. 5 is a fragmentary schematic elevational view of a portion of the machine shown in FIG. 4, with parts broken away and omitted and with certain of the components shown in a different position.

Shown in FIG. 4 of the drawings is a machine 11 which is adapted for cutting a wire into a plurality of wire lengths and forming the wire lengths into U-shaped links 13 (See FIGS. 2 and 3) each having a main body in the form of a pair of adjacently located, generally co-planar leg portions 15, together with a bite portion which is in the form of an untwisted and enlarged eye 17 and which integrally connects one end of the leg portions 15. The machine 11 also operates to twist the bite portions of the links 13 relative to the leg portions 15 to located the eyes 17 in generally co-planar relation to the leg portions 15. In addition, the machine 11 is also adapted for assembling the links 13 into a chain 19 (See FIG. 2) by bending the other or free ends of the leg portions 15 to form loops 21 which extend through the eye 17 of an adjacent link 13. Still further in addition, the machine 11 is also operative to manufacture a wire fabric 23 (See FIG. 3) which is adapted for use in mattresses, cushions or the link, and which is fabricated by cutting another wire into a plurality of cross links or members 20 and by forming the ends of the cross links 20 into laterally spaced loops 22 which respectively extend through the eyes 17 of a pair of laterally adjacent links 13 in a pair of laterally adjacent chains 19.

The machine 11 comprises a frame 51 which rotatably supports an input shaft 53 driven by a suitable power source, such as the illustrated electric motor 54. The input shaft 53 drives the various mechanisms which convert the wire into the links 13 which, in turn, are integrated by the machine 11 into the chains 19 (See FIG. 2) which, in turn, are integrated into the fabric 23 shown in FIG. 3.

More particularly, the machine 11 includes a wire cut-off station (not specifically shown) which functions to cut the wire into successive pieces (not shown) of desired length. Such pieces are then transported by a mechanism (not shown) to a link forming station (not specifically shown) in which the pieces are successively bent into the U-shaped links 13 which include the pair of adjacent, co-planar leg portions 15 and an untwisted enlarged eye 17.

Figure 6:
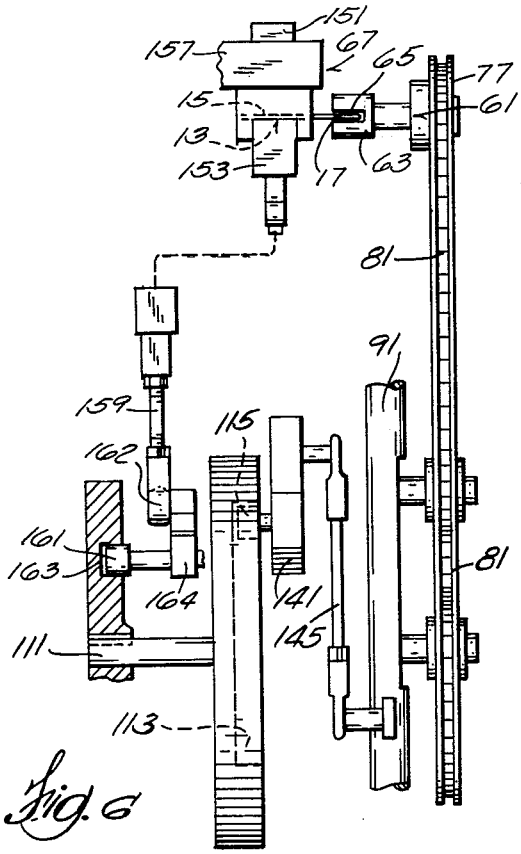
FIG. 6 is a partially schematic, fragmentary view taken generally along line 6—6 of FIG. 5.

The thusly formed links 13 are then transported by a mechanism (not shown) to an eye twisting station, apparatus, or mechanism 61 including a rotatable head 63 (See especially FIG. 6) which is rotatably supported by the frame 51 and which includes a transverse slot 65 having a width slightly greater than the wire thickness. At the end of each operational cycle, the slot 65 is located for entry or receipt therein of the eye 17 of the next link 13 which is transported to the eye twisting station 61. The eye twisting station also includes gripping means 67 (See especially FIG. 7) for releasably fixedly holding the leg portions 15 of the link 13 to permit twisting of the eye 17 relative to the leg portions 15 by the rotatable head 63.

In addition to locating the eye 17 in the slot 65 of the rotatable twisting head 63 incident to transportation of the next link 13 to the eye twisting station 61, such link movement also serves to locate the free or other ends of the leg portions 15 in overlying relation to the twisted eye 17 of the preceding or previously twisted link 13. Accordingly, simultaneously with twisting of the eye 17 of the link 13 held by the gripping means 67, (as will hereinafter be explained) the free or other ends of each of the leg portions 15 are bent downwardly by the machine 11 through the eye 17 of the previously twisted link 13 and thereafter are bent upwardly through a total angle of about 180° to form respective loops 21 which capture the eye 17 of the preceding link 13 to thereby produce the row of chain 19 of series connected links 13.

Upon completion of the eye twisting and loop forming operation, the gripping means 67 is released and the link 13, which is now a part of the chain 19 of series connected links 13 is moved by a mechanism (not shown) so as to locate the eye 17 in position for connection to the suceeding link 17 by reason of the loop forming operation just referred to.

Subsequently, the links 13 are cross connected by the cross members to laterally adjacent other links 13 in a laterally adjacent chain 19 forming a part of a link fabric 23. As above described, the machine is known in the art, operates in a known manner, and will therefore not be further explained.

The invention involves the eye twisting mechanism 61 as well as the link 13 and fabric 23 which result from operation of the eye twisting mechanism 61.

In accordance with the invention, the eye twisting mechanism 61 is initially operative to twist the eye 17 in one rotational direction into generally co-planar relation to the leg portions 15 of the link 13 through a predetermined angle which is approximately a multiple of 180°. In the specifically illustrated construction, the eye 17 is twisted through an angle of about 360°. Thereafter, the eye 17 is additionally twisted in the same rotative direction through an additional angular distance to compensate for the inherent tendancy of the eye to self rebend or reverse twist or unwind to some extent upon completion of the machine twisting operation. The extent to which the eye 17 will unwind or reverse twist is dependent upon the total amount of twist and the size and temper of the wire. Thus, in order to provide a link 13 which includes an eye 17 in generally co-planar relation to leg portions 15 after completion of the machine twisting operation, the eye 17 is over twisted in order to compensate for the self-induced reverse twist which occurs after completion of the machine twisting operation.

Thus, in the machine 11, means are provided, as already indicated, for initially rotating the head 63 (and thus twisting the eye 17) through a predetermined angle which is a multiple of 180° in response to one portion of the rotational cycle of the input shaft 53 and for thereafter additionally rotating the head 63 (and thus additionally twisting the eye 17) in the same rotative direction through an additional angular distance in response to another portion of the rotational cycle of the input shaft 53. Preferably, the amount through which the eye 17 is additionally twisted is adjustable so as to compensate for wire of different size and temper.

More specifically, the eye-twisting means comprises the before mentioned rotatably mounted head 63, and means for rotatably driving the head 63 during one portion of the rotational cycle of the input shaft 53. In this regard, there is provided means for intermittently rotating the head 63. While other arrangements are possible, in the illustrated construction, such means comprises an intermittent rotation mechanism 71 such as a geneva wheel mechanism, or other like mechanism. The intermittent rotation mechanism is mounted on the frame 51 and is drivingly connected to the input shaft 53 and includes or drives an output or power delivery shaft 73 which rotates intermittently, notwithstanding continuous rotation of the input shaft 53, and which is held or locked against rotation during intervals between output shaft rotation.

In the illustrative construction, the intermittent rotation mechanism 71 is connected by a chain drive 74 to a cam shaft 111 still to be described and thence to the input shaft 53 as will also be explained. In addition, the output shaft 73 is driven from the intermittent rotation mechanism 71 by a gear train includng meshed gears 76 and 78.

The twisting mechanism 61 also includes a chain drive 75 for rotating the head 63 in response to intermittent rotation of the output shaft 73. In this regard, there is provided a first sprocket 77 which is supported by the frame 51 for rotation about an axis fixed relative to the frame and which is drivingly connected to the head 63 and a second sprocket 79 which is supported by the frame 51 for rotation about an axis fixed relative to the frame and which is driven by the output shaft 73. In addition, a chain 81 is trained with the inside surface 83 thereof in engagement with and around the first and second sprockets 71 and 79.

The means for additionally twisting the eye 17 comprises, in addition to the intermittent rotation mechanism 71, third and fourth sprockets 85 and 87 which are rotatably supported by the frame 51 about respective axes fixed relative to the frame 51 and which engage the inside surface 83 of the chain 81 so as to provide, in cooperation with the first and second sprockets 77 and 79, a generally rectangular sprocket pattern.

In addition to the foregoing, the means for additionally twisting the eye 17 includes a member 91 supported by the frame 51 for movement relative to the frame 51. In the illustrated construction, the member 91 comprises an elongated bar mounted for linear reciprocation relative to the frame 51 by spaced guides 93 mounted on the frame 51. Rotatably mounted on the member 91 about spaced axes fixed relative to the member 91 are a pair of fifth and sixth sprockets 95 and 97 which engage the outside surface 99 of the chain 81 to form the chain 81 with oppositely extending concavely outward chain portions 101.

Means are connected between the member 91 and the input shaft 53 for displacing the member 91 during the period or interval when the intermittently rotated output shaft 73 is locked against rotation so as to thereby additionally rotate the head 63 in the same direction as during initial eye-twisting operation. While various means can be employed, in the illustrated construction, such means comprises a cam shaft 111 driven continuously from the input shaft 53 and having thereon a cam track 113 engaged by a follower 115 connected to the member 91 so as to displace the member 91 in the proper direction when the intermittently rotating output shaft 73 is locked against rotation so as thereby to rotate the head in the one direction.

More particularly, the cam shaft 111 is rotatably mounted by the frame 51 and has mounted thereon a bevel gear 121 which is in mesh with a bevel gear 123 mounted on a cross shaft 125 supported for rotation by the frame 51. In turn, the cross shaft 125 has mounted thereon a sprocket 127 connected by a chain 129 with a sprocket 131 on the input shaft 53. Thus, the cam shaft 111 is continuously driven by the input shaft 53.

As already pointed out, the intermittent rotation mechanism 71 is driven by the chain drive 74 from the cam shaft 111.

While other arrangements are possible, the follower 115 is connected to the member 91 by means affording adjustment in the stroke or length of displacement of the member 91 so as to adjustably vary the angular extent of additional twisting. In this last regard, the follower 115 is mounted on a lever 141 supported from the frame 51 about a pivot 143. In turn, the lever 141 is connected to the member 91 by an element 145 which is preferably adjustable in length and which is pivotally connected at its lower end, at 146, to the member 91 and which, at its upper end, is adjustably and pivotally connected to the lever 141. More specifically, the lever 141 includes an arcuate slot 147 which extends lengthwise of the lever 141 in the direction away from the pivot 143 and the element 145 is adjustably connected in the slot by suitable means such as an adjustable bolted connection 149. Thus, when the adjustable connection 149 is moved closer to the pivot 143, the stroke length of the member 91 is reduced and when the adjustable connection 149 is moved away from the pivot 143, the stroke length of the member 91 is increased.

Means are provided for actuating the gripping means 67 to grip the link 13 prior to the initial eye twisting operation, and to release the grip on the link 13 subsequent to completion of the additional eye-twisting operation.

Figure 7:
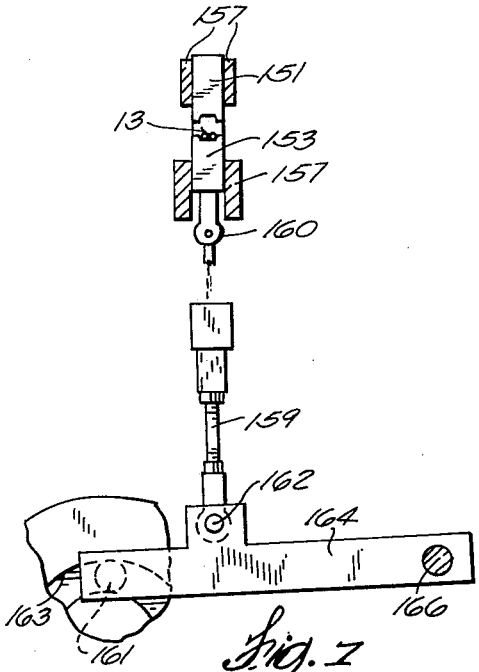
FIG. 7 is a partially schematic, fragmentary view of the gripping means incorporated in the machine shown in FIG. 4.

Thus, in the construction illustrated in FIG. 7, the gripping means includes a movable clamp or hold down 151 which grips the leg portions 15 of the link 13 against a fixed anvil or platten 153 fixedly supported on the frame 51. The movable clamp 151 is guided for travel by suitable guides 157 fixed on the frame 51 and is acuated by an element 159 which is pivotally connected to the clamp 151 at 160, and which is pivotally connected at 162 to a lever 164 which carries a follower 161 engaged in a cam track 163 on the cam shaft 111. In turn, the lever 164 is pivotally carried by the frame 13 about a pivot 166 co-axial with the pivot 143. The cam track 163 is, of course, designed to provide the desired motion at the desired time and to otherwise maintain the clamp 151 in link holding or gripping position during the initial and additional eye twisting operations.

In operation, rotation of the output shaft 73 by the intermittent rotation mechanism 71 serves to displace the chain 81 so as to rotate the head 63 in one direction. Thereafter, when the sprocket 70 on the intermittently rotating output shaft 73 is fixed against rotation, the member 91 is displaced upwardly, thus causing the chain to move relative to the sprocket 77 so as to rotatably drive the head 63 through an additional angular amount in the same rotative direction and so as thereby to additionally twist the eye 17. Thereafter, the head 63 is reverse rotated through the additional angular amount in response to return downward movement of the member 91. After such return rotative head movement, the link 13 is displaced by the machine 11 so as to remove the eye 17 from the head 63 and thereafter another link 13 is transported by the machine 11 to locate the eye 17 in the head 63 at the beginning of another machine cycle.

Operation of the machine 11 serves to twist the eyes 17 of all of the links 13 in the same rotative direction whereas, in previous machines, the eye 4 of one link 6 was twisted in one direction and the eye 4 of the next link 6 was twisted in the opposite direction as shown in FIG. 1. Furthermore, in the eye-twisting mechanism 61, the amount of additional twisting of the eye 17 is adjustable so as to accommodate for variation in wire temper, size, and the amount of initial twisting. In addition, the eye-twisting mechanism 61 facilitates substantially increased operational speed as compared to previous machines.

As indicated above, the invention relates to the eye-twisting mechanism 61 as well as to the resulting chain 19 and fabric 23.

Various of the features of the invention are set forth in the following claims:

I claim:

1. A mechanism adapted for twisting an eye formed at one end of a U-shaped link, said mechanism comprising a frame, an input shaft supported by said frame for rotation and adapted to be rotated by a power source, means of said frame for gripping the link against movement and with the eye extending from said gripping means, and means on said frame and connected to said input shaft for twisting the eye in one direction through a first angular distance in response to one portion of the rotational cycle of said input shaft and for additionally twisting the eye in said one direction through an additional angular distance in response to another portion of the rotational cycle of said input shaft, said twisting means including a rotatable head engagable with the extending eye and a linkage connected between said input shaft and said head and including two alternately moving portions.

2. A mechanism in accordance with claim 1 wherein said linkage includes an output shaft rotatably supported by said frame, means connected between said input shaft and said output shaft for intermittently rotating said output shaft in response to rotation of said input shaft, means connected between said output shaft and said head for rotating said head to twist the eye in one direction through a first angular dstance in response to rotation of said output shaft, and additional means connected to said input and to said means connected between said output shaft and said head for additionally rotating said head to twist the eye in said one direction through an additional angular distance in response to rotation of said input shaft during non-rotation of said output shaft.

3. A mechanism in accordance with claim 2 wherein said means connected between said input shaft and said output shaft comprises a geneva-wheel mechanism.

4. A mechanism in accordance with claim 2 wherein said head includes therein a slot which receives the eye, and means for rotating said head in one direction in response to rotation of said output shaft.

5. A mechanism in accordance with claim 2 wherein said linkage further comprises first, second, third, and fourth spaced sprockets rotatably mounted by said frame about respective axes fixed with respect to said frame, with said first sprocket being drivingly connected to said head and with said second sprocket being rotatably driven by said output shaft, an endless chain having an inside surface trained around said first, second, third, and fourth sprockets, and having an outside surface, a member mounted on said frame for movement relative thereto, fifth and sixth sprockets mounted on said member in spaced relation for rotation about axes fixed relative to said member and engaging said outside surface of said chain to arrange said chain with two oppositely extending outwardly concave portions, and means connected between said member and said input shaft for displacing said member in response to rotation of said input shaft and when said second sprocket is held against rotation by said output shaft so as to effect movement of said chain relative to said first sprocket such that said first sprocket is additionally rotated in said one direction.

6. A mechanism in accordance with claim 5 wherein said member is mounted for rectilinear movement.

7. A mechanism in accordance with claim 6 wherein said means for displacing said member includes a cam track supported for rotation by said frame and driven by said input shaft, and a follower connected to said member and engaged with said cam track.

8. A mechanism in accordance with claim 5 wherein said means for displacing said member includes means permitting adjustment of the displacement distance of said member so as to adjustable very the amount of additional twisting.

9. A mechanism in accordance with claim 8 wherein said adjusting means comprises a lever pivotally mounted on said frame and having said follower thereon, an element pivotally connected to said member, and means adjustably and pivotally connecting said element to said lever.

10. A mechanism in accordance with claim 9 wherein said element is adjustable in length.

11. A mechanism in accordance with claim 1 and further including means connecting said input shaft and said gripping means for effecting gripping of the link prior to twisting thereof and for releasing gripping of the link after completion of the twisting thereof.

12. A method of fabricating a chain of links for a wire fabric comprising the steps of forming a plurality of wire lengths into U-shaped links each having a leg portion including a pair of coplanar parallel legs integrally connected by a bite portion forming an eye, initially twisting the bite portions and leg portions relative to each other in the same rotative direction through a predetermined angular distance of at least about 180° to locate the bite portions and leg portions in coplanar relation to each other and thereafter additionally twisting the bite portions and leg portions relative to each other in said frame rotative direction through an additional predetermined angular distance such that, upon completion of said additional twisting, the bite portions and leg portions will automatically self reverse twist relative to each other to the position in coplanar relation to each other, and assembling the links to one another after said twisting with the bite portions all being twisted in the same direction and all being in generally coplanar relation to each other.

13. A method of fabricating a wire fabric for a mattress or the like comprising the steps of forming a plurality of wire lengths into U-shaped links each having a leg protion including a pair of coplanar parallel legs integrally connected by a bite portion forming an eye, initially twisting the bite portions and leg portions relative to each other in the same rotative direction through a predetermined angular distance of at least about 180° to locate the bite portions and leg portions in coplanar relation to each other and thereafter additionally twisting the bite portions and leg portions relative to each other in said same rotative direction through an additional predetermined angular distance such that, upon completion of said additional twisting, the bite portions and leg portions portion automatically self reverse twist relataive to each other to the position in coplanar relation to each other, assembling the links to one another after said twisting to provide a plurality of link chains with all of the bite portions being twisted in the same direction and being in generally coplanar relation to one another, and assembling the link chains to one another in generally parallel relation.

14. A method in accordance with claim 13 wherein said step of assembling the link chains includes bending the ends of a plurality of wire lengths through adjacent eyes in the parallel link chains.

15. A mechanism adapted for twisting a U-shaped link, formed, at one end, with an eye portion and formed with a leg portion extending from the eye portion, said mechanism comprising a frame, an input shaft supported by said frame for rotation and adapted to be rotated by a power source, means on said frame for gripping one portion of the link against movement and with the other portion extending from said gripping means, and means on said frame and connected to said input shaft for twisting the other portion of the link in one direction through a first angular distance in response to one portion of the rotational cycle of said input shaft and for additionally twisting the other portion of the link in said one direction through an additional angular distance in response to another portion of the rotational cycle of said input shaft, said twisting means including a rotatable head engageable with the other portion and a linkage connected between said input shaft and said head and including two alternately moving portions.

16. A mechanism in accordance with claim 15 wherein said linkage includes an output shaft rotatably supported by said frame, means connected between said input shaft and said output shaft for intermittently rotating said output shaft in response to rotation of said input shaft, means connected between said output shaft and said head for rotating said head to twist the other portion in one direction through a first angular distance in response to rotation of said output shaft, and additional means connected to said input shaft and to said means connected between said output shaft and said head for additionally rotating said head to twist the other portion in said one direction through an additional angular distance in response to rotation of said input shaft during non-rotation of said output shaft.

17. A mechanism in accordance with claim 16 wherein said means connected between said input shaft and said output shaft comprises a geneva-wheel mechanism.

18. A mechanism in accordance with claim 16 wherein said head includes therein a slot which receives the other portion, and means for rotating said head in one direction in response to rotation of said input shaft.

19. A mechanism in accordance with claim 16 wherein said linkage further comprises first, second, third, and fourth spaced sprockets rotatably mounted by said frame about respective axes fixed with respect to said frame, with said first sprocket being drivingly connected to said head and with said second sprocket being rotatably driven by said output shaft, an endless chain having an inside surface trained around said first, second, third, and fourth sprockets, and having an outside surface, a member mounted on said frame for movement relative thereto, fifth and sixth sprockets mounted on said member in speced relation for rotation about axes fixed relative to said member and engaging said outside surface of said chain to arrange said chain with two oppositely extending outwardly concave portions, and means connected between said member and said input shaft for displacing said member in response to rotation of said input shaft and when said second sprocket is held against rotation by said output shaft so as to effect movement of said chain relative to said first sprocket such that said first sprocket is additionally rotated in said one direction.

20. A mechanism in accordance with claim 19 wherein said member is mounted for rectilinear movement.

21. A mechanism in accordance with claim 20 wherein said means for displacing said member includes a cam track supported for rotation by said frame and driven by said input shaft, and a follower connected to said member and engaged with said cam track.

22. A mechanism in accordance with claim 20 wherein said means for displacing said member includes means permitting adjustment of the displacement distance of said member so as to adjustably vary the amount of additional twisting.

23. A mechanism in accordance with claim 22 wherein said adjusting means comprises a lever pivotally mounted on said frame and having said follower mounted thereon, an element pivotally connected to said member, and means adjustably and pivotally connecting said element to said lever.

24. A mechanism in accordance with claim 23 wherein said element is adjustable in length.

25. A mechanism in accordance with claim 15 and further including means connecting said input shaft and said gripping means for effecting gripping of one portion of the link prior to twisting and for releasing gripping of one portion of the link after completion of the twisting.

* * * * *

PO-1050
(5/69)

UNITED STATES PATENT OFFICE
CERTIFICATE OF CORRECTION

Patent No. 3,954,125 Dated May 4, 1976

Inventor(s) Horst F. Wentzek

It is certified that error appears in the above-identified patent and that said Letters Patent are hereby corrected as shown below:

| | |
|---|---|
| Column 8, line 20 | delete "of", insert ---on---. |
| Column 8, line 42 | after "input", insert ---shaft---. |
| Column 9, line 23 | after "follower", insert ---mounted---. |
| Column 9, line 45 | delete "frame", insert ---same---. |
| Column 9, line 57 | delete "protion", insert ---portion---. |

Signed and Sealed this

Fourth Day of January 1977

[SEAL]

*Attest:*

RUTH C. MASON
*Attesting Officer*

C. MARSHALL DANN
*Commissioner of Patents and Trademarks*